United States Patent [19]

Grisebach

[11] 4,273,383

[45] Jun. 16, 1981

[54] MINERAL WINNING MACHINES

[75] Inventor: Hans-Theodor Grisebach, Unna, Fed. Rep. of Germany

[73] Assignee: Gewerkschaft Eisenhutte Westfalia, Lunen, Fed. Rep. of Germany

[21] Appl. No.: 16,745

[22] Filed: Mar. 2, 1979

[30] Foreign Application Priority Data

Mar. 3, 1978 [DE] Fed. Rep. of Germany ..... 2809132

[51] Int. Cl.[3] ..... E21C 27/00

[52] U.S. Cl. ..... 299/23; 299/86; 299/53

[58] Field of Search ..... 299/23, 86, 92–94, 299/10, 53

[56] References Cited

U.S. PATENT DOCUMENTS

| | | | |
|---|---|---|---|
| 2,057,684 | 10/1936 | Joy | 299/10 |
| 2,572,403 | 10/1951 | Stevenson | 299/23 |
| 3,139,148 | 6/1964 | Robbins | 299/86 |
| 3,313,576 | 4/1967 | Dommann | 299/53 |
| 4,062,594 | 12/1977 | Haspert | 299/86 |

*Primary Examiner*—William F. Pate, III

*Attorney, Agent, or Firm*—Thompson, Birch, Gauthier & Samuels

[57] ABSTRACT

A mineral winning machine is moved back and forth along a mineral, e.g., coal, face to win mineral by a combination of cutting and wedging actions. To effect this winning mode, the machine has at least one cutting device with a cutting disk rotating in front of a frusto-conical wedging body which revolves in an eccentric manner to detach the mineral previously backcut by the disk. The wedging body and the cutting disk are driven by separate concentric drive shafts, preferably with variable speed regulation with the disk rotating faster than the wedging body. In an alternative construction, a cutting chain equipped with both cutting and wedging tools in differential relationship is circulated and engages the mineral face.

10 Claims, 6 Drawing Figures

MINERAL WINNING MACHINES

BACKGROUND OF THE INVENTION

The present invention is concerned with mineral winning machines which are moved back and forth along a mineral, e.g. coal face, to win mineral by a combination of cutting, especially back-cutting, and wedging actions. A machine of this type is described in German Pat. No. 2260684. In this known machine, the mineral is won by means of a unitary cutting device composed of a rotatable cutting disk joined to an eccentric frusto-conical body which effects a wedging action on the mineral previously back-cut by the disk.

SUMMARY OF THE INVENTION

The invention is based on the realization that the cutting and wedging actions are incompatible. That is, the high rotational speeds desired for the cutting disk necessitates a high driving performance for the unitary cutting device and a high rotational speed for the wedging body is not necessary or even desirable. Although it is possible to increase the size of the cutting disk, the present invention provides that the disk or other cutting means and the wedging means are both movable or rotatable individually so that the cutting means can move or rotate relative to the wedging means if desired. Preferably, the cutting means and the wedging means have separate drive systems. Although the wedging and cutting means can have entirely separate drive means, it is possible to employ a common drive means driving the individual means through separate gear trains, for example. In general, the cutting means can be moved, usually rotated, at a higher speed than the wedging means so that both means can move or rotate at optimum speed to provide a high mineral output from the machine. To cope with different seam conditions, it is advantageous to have the rotational speeds reversible and variably regulated collectively or individually. It is also possible to have the wedging means only driven intermittently in relation to the cutting means.

In a preferred embodiment of the invention, the wedging means is a rotatable frusto-concial wedging body, known per se, mounted behind a cutting disk to adopt an eccentric position in relation to its rotational axis. The wedging body can then be driven by a hollow drive shaft while the cutting disk is driven by a drive shaft extending through the hollow shaft.

To provide a larger depth of cut, and hence a greater output of mineral, it is desirable to provide a machine with a plurality of cutting devices constructed in accordance with the invention and to have the devices staggered in the sense of their individual depths of cut.

Instead of adopting a cutting disk as the cutting means, it is also possible to utilize a cutting chain, i.e., a chain equipped with cutting tools. In this case, the speed of circulation of the chain can again be different to that of the rotational speed of the wedging means.

In another solution, the present invention provides a machine which employs a circulatable chain equipped with cutting tools for cutting a mineral face and wedging tools for detaching mineral by a wedging action. One section of the chain can be equipped with cutting tools only while another section, preferably shorter than the one section, is equipped solely with wedging tools. In this way, although the cutting tools and wedging tools are driven, i.e. circulated, at the same speed, the greater number of cutting tools can counteract the loss of speed differential as compared to the other solutions. It is advisable to mount the chain for positional adjustment in the vertical sense to vary the height of the cut.

The invention may be understood more readily and various other features and aspects of the invention may become apparent from consideration of the following description.

BRIEF DESCRIPTION OF DRAWINGS

Embodiments of the invention will now be described, by way of examples only, with reference to the accompanying drawings, wherein.

DESCRIPTION OF PREFERRED EMBODIMENTS

Figure 1:
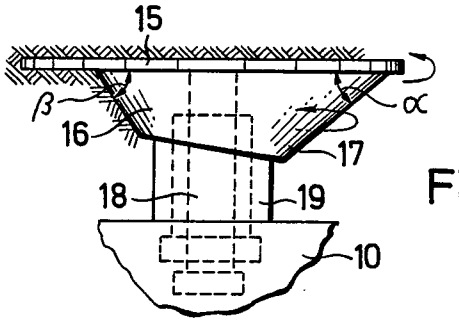
FIG. 1 is a diagrammatic plan view of a cutting device of a mineral winning machine made in accordance with the invention.
Figure 2:
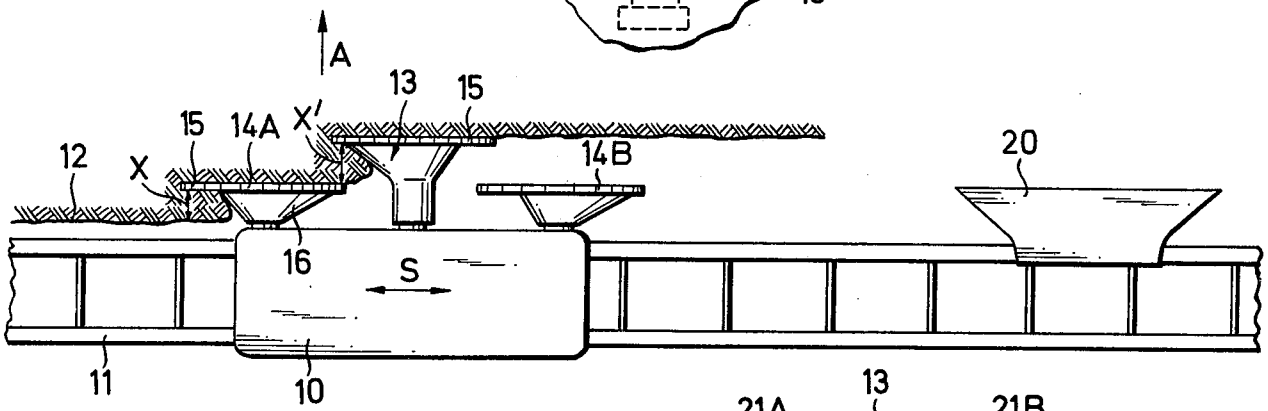
FIG. 2 is a diagrammatic plan view of a mineral winning machine made in accordance with the invention.

Referring initially to FIG. 2, a mineral, e.g., coal, winning machine has a body 10 guided for movement back and forth (arrows S) on (as illustrated) or alongside a scraper-chain conveyor 11. The body 10 is driven by any suitable drive means, such as a chain or means carried by the body 10. The body 10 is equipped with three cutting devices or heads 13, 14A, 14B which are staggered in the advancing direction A. The heads 13, 14A, 14B co-operate to win mineral from a mineral face 12 by a combination of cutting and wedging actions as the body 10 moves back and forth in the directions of arrows S. The cutting devices 13, 14A, 14B are constructed in the manner depicted in FIG. 1. As shown in FIG. 1, each cutting device 13, 14A, 14B is composed of a rotatable cutting disk 15 conveniently of circular form provided with cutters, e.g. tools or teeth, on its periphery. At the rear side of the disk 15 relative to the mineral face, there is provided a rotatable wedging body or means 16, here in the form of a truncated cone. The frusto-conical wedging body 16 has an external working surface 17 which is eccentric or asymmetrical relative to its rotational axis. Thus, the angle $\alpha$ is smaller than the angle $\beta$. The wedging body 16 effectively serves to split off a portion of the mineral face previously back-cut by the cutting disk 15 in a wedging action as can be appreciated from FIG. 1. The wedging body 16 is mounted on a hollow drive shaft 19 and the cutting disk 15 is mounted on a drive shaft 18 which extends through the shaft 19. During operation, the shafts 18,19 rotate about a common axis arranged in the advancing direction A. The shafts 18,19 are preferably driven at different speeds with the shaft 19 rotating at a lower speed than the shaft 18. When difficult mineral seams are being worked, such as with hard coal, the disk 15 is best driven at considerably higher speed than the working means. The body 10 of the associated winning machine supports either separate drive means for driving the shafts 18,19 individually or else a common drive means which drives the shafts 18,19 e.g., through different gear trains. It is preferable to provide means for regulating at least the rotational speed of the shaft 19, although regulating means can regulate the rotational speeds of both shafts 18,19 together or relative to one another. Such regulating means can easily be incorporated with variable speed gearing. It is also preferable to provide means for reversing the direction of rotation of the shafts 18,19. It is also possible to arrange for the shaft 19 to be driven intermittently.

Referring again to FIG. 2, it is assumed that the machine body 10 is moving to the left of the Figure so that the leading device 14A attacks the face or seam 12 by an overall depth of cut X. The central device 13, which projects further in the advancing direction A than the device 14A, attacks the face 12 immediately after the device 14A by an overall depth of cut X' which may be the same or different to the depth of cut X. The device 14B is inoperative during this direction of travel. Where X is the same as X' the combined depth of cut performed by the machine is, of course, 2X and generally the depth X is about 20 to 40 cms. When the machine reverses direction to proceed to the right of FIG. 2, the situation is reversed with the device 14B first detaching mineral from the face and the device 13 following up as before. In this direction of travel the device 14A is inoperative. Since the device 13 cuts the face 12 in both directions of travel, it may be desirable to reverse the direction of rotation of its shafts 18,19 when the body 10 changes its direction of travel. The mineral, e.g., coal, detached by the machine 10 is loaded into the conveyor 11 by means of one or more loading ploughs 20 likewise guided for movement along the conveyor 11. The plough(s) 20 can be combined with the body 10 to form a constructional assembly moved as a whole along the conveyor 11.

Figure 3:
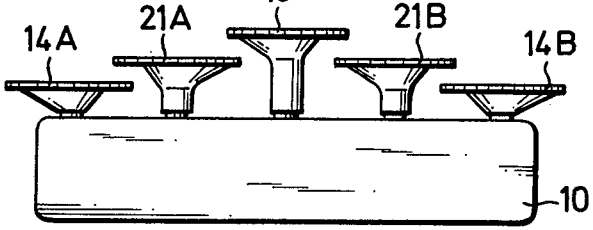
FIG. 3 is a diagrammatic plan view of another mineral winning machine made in accordance with the invention.

Although the winning machine shown in FIG. 2 employs three cutting devices 13,14A,14B, it is in general possible to provide one or more devices on the machine. Thus, FIG. 3 depicts another machine here provided with five devices 14A, 21A, 13, 21B, 14B. In contrast to FIG. 2, intermediate devices 21A,21B, are disposed between the central device 13 and the outer devices 14A,14B. If the respective depths of cut of each device 14A, 21A, 13, 21B, 14B is again X then the machine of FIG. 5 will perform a total depth of cut of 3X for each direction of travel.

In a further embodiment of the invention a machine body is again provided with one or several cutting devices which employ the wedging means 16 generally as depicted in FIG. 1. However, instead of employing a cutting disk 15 in front of the wedging means 16, the machine has a common endless circulating cutting chain, i.e. a chain equipped with cutting tools. The cutting chain can be guided by guide means which takes the place of the cutting disk 15. The wedging means 16 would normally rotate relative to the chain guide means and the latter may be fixed to the machine body 10. It is, however, possible to have a chain guide which is fixed to the wedging means 16 for rotation therewith.

Figure 4:
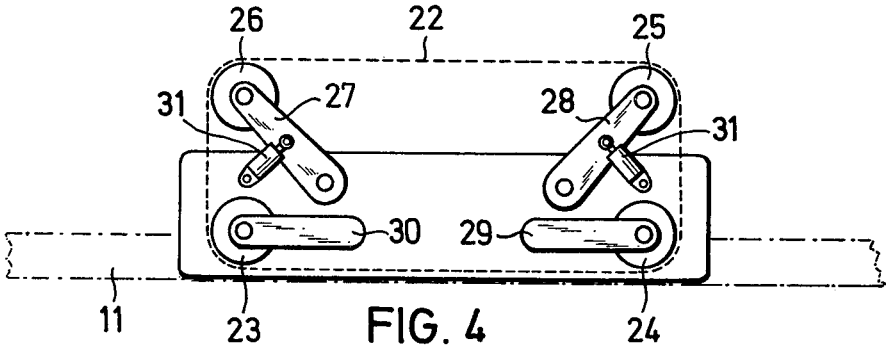
FIG. 4 is a diagrammatic elevation of a further mineral winning machine made in accordance with the invention.
Figure 5:
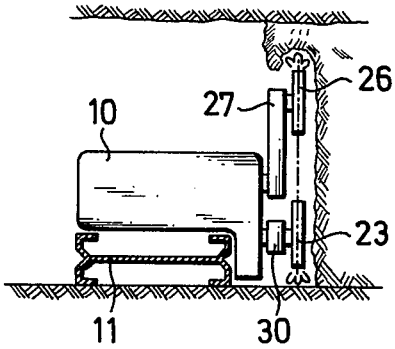
FIG. 5 is a diagrammatic end view of the machine depicted in FIG. 4.
Figure 6:
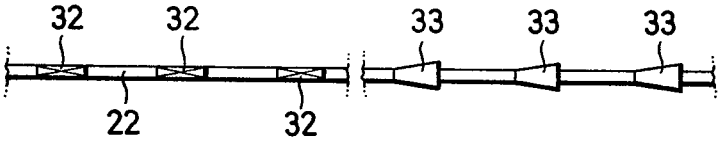
FIG. 6 is a diagrammatic plan view of the cutting device used with the machine depicted in FIGS. 4 and 5.

FIGS. 4 to 6 depict an embodiment with a machine body 10, again guided on a scraper-chain conveyor 11. This machine employs an endless chain 22 or the like which circulates around guide and drive wheels 23 to 26 mounted on respective arms 27 to 30 pivotably or rigidly connected to the body 10. Devices 31 here in the form of hydraulic piston and cylinder units are provided for swivelling the upper pivotable arms 27,28 in a vertical plane to adjust the height of the wheels 25,26. The lower arms 29,30 can be fixed in position. The chain 22 is equipped with cutting tools 32 and wedging tools 33 as depicted in FIG. 6. Adjustment of the arms 27,28 controls the height of cut effected by the chain 22. It is preferable to arrange several cutting tools 32 over one section of the chain and several wedging tools 33 over another section of the chain and to have the section bearing cutting tools 32 considerably larger than that bearing the wedging tools 33.

I claim:

1. A mineral winning machine guided for movement back and forth alongside a mineral face and equipped with a plurality of separate cutting devices which are staggered and serve to cut into the mineral face to different depths as the machine progresses along the mineral face, wherein: each cutting device is composed of rotary cutting means for initially cutting into the mineral face and rotary wedging means for detaching mineral in a wedging action after the initial cutting operation performed by the associated cutting means, the cutting means and the wedging means of each device being rotatable about a common axis and, wherein drive means is provided for driving the cutting means and the wedging means of each device separately and individually with the cutting means being driven at a higher rotational speed than the wedging means.

2. A machine according to claim 1, wherein the wedging means and the cutting means of each cutting device are driven by way of concentric drive shafts.

3. A machine according to claim 2, wherein the drive shaft for the cutting means extends through the drive shaft for the associated wedging means.

4. A machine according to claim 1, wherein the wedging means and cutting means of each cutting device are driven by separate drive means.

5. A machine according to claim 1, wherein at least the relative rotational speeds of the wedging means and the cutting means of each cutting device is variably regulated.

6. A machine according to claim 1, wherein the cutting means of each cutting device is in the form of a disc with cutters on its periphery.

7. A machine according to claim 1, wherein the cutting means of each cutting device is in the form of a circulatable cutting chain.

8. A machine according to claim 1, wherein the wedging means of each cutting device consists of a body in the form of a truncated cone with an exterior working surface eccentric in relation to its rotational axis.

9. A machine according to claim 1, wherein the cutting means of each cutting device has a larger dimension radially of the common axis of rotation than the wedging means.

10. A machine according to claim 9, wherein the wedging means of each cutting device has a larger dimension axially of the common axis of rotation than the cutting means.

* * * * *